US010866067B2

(12) United States Patent
Raber

(10) Patent No.: US 10,866,067 B2
(45) Date of Patent: Dec. 15, 2020

(54) ARMOR SYSTEM FOR THE GROIN

(71) Applicant: Nutshellz, LLC, High Ridge, MO (US)

(72) Inventor: Jeremiah Raber, High Ridge, MO (US)

(73) Assignee: Nutshellz, LLC, High Ridge, MO (US)

( * ) Notice: Subject to any disclaimer, the term of this patent is extended or adjusted under 35 U.S.C. 154(b) by 0 days.

(21) Appl. No.: 16/175,321

(22) Filed: Oct. 30, 2018

(65) Prior Publication Data

US 2019/0137222 A1 May 9, 2019

Related U.S. Application Data

(60) Provisional application No. 62/578,924, filed on Oct. 30, 2017.

(51) Int. Cl.

| | |
|---|---|
| ***A63B 71/12*** | (2006.01) |
| ***F41H 1/02*** | (2006.01) |
| ***A41D 13/05*** | (2006.01) |
| ***F41H 5/04*** | (2006.01) |
| *F41H 1/06* | (2006.01) |

(52) U.S. Cl.

CPC ..... *F41H 1/02* (2013.01); *A41D 13/0525* (2013.01); *A63B 71/1216* (2013.01); *F41H 5/0414* (2013.01); *F41H 5/0471* (2013.01); *F41H 1/06* (2013.01); *F41H 5/0428* (2013.01)

(58) Field of Classification Search

CPC ..... A63B 71/1216; F41H 1/02; A41D 1/088; A41D 13/0525; A41D 2600/10

See application file for complete search history.

(56) References Cited

U.S. PATENT DOCUMENTS

| | | | | |
|---|---|---|---|---|
| 4,257,414 A * | 3/1981 | Gamm | A63B 71/1216 | 602/67 |
| 4,467,476 A * | 8/1984 | Herbert | G21F 3/03 | 2/2.5 |
| 4,580,296 A * | 4/1986 | Cano | A63B 71/145 | 2/18 |
| 5,134,726 A * | 8/1992 | Ross | A41D 1/08 | 2/465 |
| 5,295,267 A * | 3/1994 | Galindo | A41D 13/0525 | 2/214 |
| 5,327,811 A * | 7/1994 | Price | F41H 1/02 | 2/2.5 |
| 5,479,942 A * | 1/1996 | DiMatteo | A61F 5/40 | 128/846 |
| 7,178,176 B1 * | 2/2007 | S-Cronenbold | A41D 1/088 | 2/403 |

(Continued)

*Primary Examiner* — Tajash D Patel
(74) *Attorney, Agent, or Firm* — Lewis Rice LLC

(57) ABSTRACT

A system and method for an armor system for protecting the groin. While the system is useful for either gender, it is particularly valuable to protect male genitalia which are particularly vulnerable to damage. The system utilizes at least one, and commonly two, armor components. One armor component is a specifically designed armor plate of the type and construction common to plates in plate carriers that is generally worn external to the pants. While the plate or "over armor" can be used alone, in an embodiment of the system, the plate is worn over a high impact ballistic cup which is inside the pants. The cup is designed to absorb impact from the over armor against the body to further protect the groin area.

18 Claims, 11 Drawing Sheets

(56) References Cited

U.S. PATENT DOCUMENTS

| | | | | |
|---|---|---|---|---|
| 7,266,850 | B1 * | 9/2007 | Strum | F41H 1/02 2/2.5 |
| 7,296,307 | B2 * | 11/2007 | Atwater | A63B 71/12 128/846 |
| 2009/0271916 | A1 * | 11/2009 | Harris | A63B 71/12 2/456 |
| 2010/0024105 | A1 * | 2/2010 | Sims | A63B 71/1216 2/466 |

* cited by examiner

PRIOR

ARMOR SYSTEM FOR THE GROIN

CROSS REFERENCE TO RELATED APPLICATION(S)

This application claims the benefit of U.S. Provisional Application Ser. No. 62/578,924, filed Oct. 30, 2017, the entire disclosure of which is herein incorporated by reference.

BACKGROUND OF THE INVENTION

1. Field of the Invention

The following disclosure relates to an armored plate and armor system of the type designed to reduce injury from being shot with a firearm, more particularly for an armor system designed to protect the groin area which can be used alone or with existing armored vests such as plate carriers.

2. Description of the Related Art

Since 2001 over 1300 American military men, mostly in their 20s and 30s, have suffered what can be referred to simply as an emasculating injury. Severe damage to the organs of the groin and urinary tract or, to use the medical term, genitourinary injuries. These types of injuries are primarily caused by explosive devices (commonly IEDs), but can also be caused by firearm projectiles, and can carry an extremely devastating psychological component. Even after physical treatment, victims of such injury have a high likelihood of suicide. While the US military has worked on obtaining improved protection for the genitals and groin area, injuries to these areas remain a nagging problem simply due to the design of the male body.

The groin, particularly for a male, is an extremely well-known point of weakness to injury. Male genitalia, which biologically must be external to most of the body to provide the intended function, are extremely vulnerable to injury compared to other organs which are often protected behind walls of bone and muscle. Further, risk of injury to the genitalia also presents a very deep-seated psychological fear to most men (which one can regularly see exploited in entertainment mediums). This combination necessarily makes attacks against the groin extremely effective both to disable the targeted individual and to create hesitation in others that may witness the first attack or fear the possibility of such an attack. Because of this, the effectiveness of such an attack is often exploited in teaching self-defense, particularly to women. However, it can also be used very effectively by those wishing simply to cause harm or who wish to exploit the hesitation of another for their own gain. One need to look no further than so-called bounding mines such as the German schrapnellmine ("Bouncing Betty") of World War II which were both highly effective anti personnel weapons and powerful psychological deterrents.

The use of the threat of injury to male genitalia to alter behavior can be far more common than one might think. There are a large number of places where slight hesitation can be exploited. For example, hitting the groin area is generally a rules violation in fighting sports such as mixed martial arts (MMA) or boxing. However, it still occurs in some instances. Often this is not to actually harm the opponent directly (which may result in a severe sanction), but to get them to flinch or hesitate at later times. Similarly, the psychological effect of such injury can also be exploited by criminals, terrorists, or opposing military forces who wish to escape or dictate the flow of an engagement by threatening a groin injury.

Direct attacks to the groin can come from a variety of sources and include blunt attacks (e.g. with a fist or baseball bat), cutting injuries (with a blade), or shooting injuries (with a firearm) as any of these types of attacks can be aimed at the groin. Explosive attacks can also hit the groin whether or not they are a target of a directed explosion. To attempt to avoid groin injuries, and to help police officers, athletes, soldiers, and those in related professions where some injury to the body is a likely outcome of the profession, protective devices for the groin have long been provided, and have recently received increased attention. Such devices serve two functions. The most obvious is to actually protect the genitalia from damage. The second, and often less obvious, is to reduce the danger which can result from hesitation caused by psychological fear of such an injury.

Male groin protection generally comes in two general forms. The first, and by far most common, is the protective cup. The cup is generally worn inside the pants and is designed to encapsulate the external male genitalia into a protective shell to give the genitalia protection akin to internal organs of the body. The second is to use flaps, skirts, kilts, or loincloths which hang in front of the groin and external to the pants, to provide a protective barrier which does not need to be accommodated by design of the pants and can be easier to support.

A major problem with both forms of protection is the effectiveness of the protection against various forms of attack coupled with the movement impairment from wearing it. Protection of the groin requires placing materials which are generally rigid and stiff in an area of the body which needs to be one of the most flexible. All forms of upright bipedal locomotion require movement of components of the groin and hips (due to the connection of the legs) and wearing of protective gear in this location can be uncomfortable and difficult. It can also be difficult to get the protection to stay put and not move during human motion, particularly if it is vigorous. Cups can shift around which can be uncomfortable and result in motion impairment, and skirts can get in the way of the motion of the legs or bounce on the legs moving them to a position where they do no good.

A further problem with many forms of protective gear is the amount of protection provided. Many cups simply utilize hard plastics to provide a barrier while protective flaps comprise padding or woven ballistic fibers. These can be effective at resisting a relatively low energy blunt or cutting injury (e.g. a kick or attack with a knife) which are common in many sports, but are often insufficient for injuries from a firearm, explosive, or other attack which produces a large amount of localized force (for example a hammer, bullet, or even a fastball or slapshot). Padded or woven flaps may be pushed aside in these cases and cups can shatter or break which can cause secondary damage.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a system and method for an armor system for protecting the groin. While the system is useful for either gender, it is particularly valuable to protect male genitalia which are particularly vulnerable to damage simply by its positioning. The system utilizes at least one, and commonly two, armor components. One armor component is a specifically designed armor "plate" of the type and construction common to plates in plate carriers that is generally worn external to the pants. While the plate or "over armor" can be used alone, in an embodiment of the system, the plate is worn over a high impact ballistic cup which is inside the pants. The cup is designed to absorb impact from the over armor against the body to further protect the groin area.

There is described herein, in an embodiment, an armor plate for use in protecting the groin, the armor plate comprising: a scoop portion forming a void; a lip portion extending from a top of the scoop portion; wherein the armor plate is sized and shaped such that the void can be placed to encapsulate male human genitalia; and wherein the armor plate is positioned external to a user's pants.

There is also described herein, in an embodiment, an armor system for use in protecting the groin, the armor system comprising: a ballistic cup comprising a void; and an armor plate including: a scoop portion forming a void; and a lip portion extending from a top of the scoop portion; wherein the ballistic cup is placed inside pants of a human user with the void in the ballistic cup encapsulating genitalia; and wherein the armor plate is positioned external to the pants placing the ballistic cup into the void in the scoop portion.

In an embodiment of the armor system, the armor plate is positioned within a carrier.

In an embodiment of the armor system, the carrier includes straps connecting the carrier to legs of the human user.

In an embodiment of the armor system, the carrier includes straps connecting the carrier to a belt around a waist of the human user.

In an embodiment of the armor system, the carrier includes straps connecting the carrier to a vest worn by the human user.

In an embodiment of the armor system, the vest is a plate carrier vest.

In an embodiment of the armor system, the plate is formed of high density sintered ceramic.

In an embodiment of the armor system, the plate is formed of high grade AR500 steel.

In an embodiment of the armor system, the plate is formed of ultra-high molecular weight polyethylene (UHMPE).

In an embodiment, the armor system further comprises a skirt which is wrapped around an edge of the plate.

In an embodiment of the armor system, the skirt is formed of ultra-high molecular weight polyethylene (UHMPE).

In an embodiment of the armor system, the skirt is formed of flexible ballistic material.

In an embodiment of the armor system, the skirt is formed of para-aramid synthetic fiber.

In an embodiment of the armor system, the plate and the skirt are coated with a coating.

In an embodiment of the armor system, the coating is a polyurethane coating.

In an embodiment of the armor system, the coating is a polyurea coating.

In an embodiment of the armor system, the human user is male.

There is also described herein, in an embodiment, a method for protecting the groin, the method comprising: providing a ballistic cup comprising a void; providing an armor plate including: a scoop portion forming a void; and a lip portion extending from a top of the scoop portion; placing the ballistic cup inside pants of a human user with the void in the ballistic cup encapsulating genitalia; and positioning the armor plate external to the pants with the ballistic cup positioned in the void in the scoop portion.

DESCRIPTION OF THE PREFERRED EMBODIMENT(S)

Figure 1:
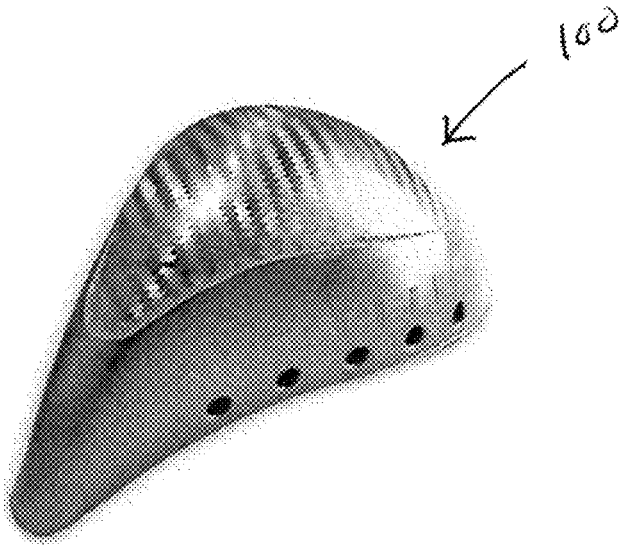
FIG. 1 shows an embodiment of a ballistic cup of the prior art.

To deal with these problems, there have previously been provided cups which are designed to withstand particularly large amounts of force without breaking. These types of cups are referred to herein as "ballistic cups" and do not prevent injury to the wearer totally but instead transfer the risk of injury from the soft tissues of the genitalia, which could be seriously damaged or destroyed by this level of force, to larger muscles and bones of the hips and legs where it can be more safely absorbed by the body resulting simply in bruising. Some of such ballistic cups (100) are manufactured and sold under the name Nutshellz™ and an embodiment is shown in FIG. 1. Such cups (100) are able to withstand the impact of slapshots, fastballs, hammers, and even bullets. Such cups (100) can also provide protection to the genitalia in an explosion.

While ballistic cups (100) are very good at providing protection to the genitalia against any type of high force injury that hits them, there is a second problem they create when the user is exposed to a potential cutting injury, particularly when it is coupled with high force as is the case of a bullet or other projectile weapon. Whether caused by a blade, arrow, or a bullet, an object directed into the cup (100) which is designed to penetrate human skin can be deflected by the cup (100) into neighboring body areas. As the cup (100) is generally shaped to be of a loosely hemispherical shape (when viewed form the side) as shown in FIG. 1 so as to provide the void for encapsulating the external genitalia while fitting between the legs, this shape generally means that an object deflected from a protective cup (100), while missing the genitalia, is often directed into the lower abdomen or inner thighs. This is caused because the cup (100) is pressed up against the large muscles of the groin and hips to dissipate force and is held in place by the shape of the hips and fabric of the pants.

The problem from this is that the inner thighs are the location of the femoral arteries, the second largest arteries in the human body, and the lower abdomen includes the colon, which is generally not protected by the ribcage. Thus, cutting objects ricocheting from a cup (100) are directed from the cup into two areas of the body particularly vulnerable to cutting type injury. A cut to the femoral artery can result in the victim quickly bleeding to death, while a cut into the colon can result in major infection and a difficult to heal injury. Thus, while a cup (100) offering high ballistic protection is highly effective at protecting external male genitalia, it is ultimately only a small piece of armor that protects a relatively small area on the male user.

Further, a traditional ballistic cup (100), like a traditional bullet resistant vest, is generally only designed to stop handgun or human strength powered cutting implement injuries (e.g. knives). It is generally not able to effectively resist high power bullets such as those fired by rifles. A cup (100) utilizing such level of protection would be heavy and difficult to keep in place during sustained movement since the weight is not well supported on the front of the body.

In situations where rifle-type weapons are likely to be encountered, the standard ballistic vest is generally upgraded to a plate carrier. This is a carrier that holds front and back rifle plates (often steel or ceramic) that is suitable to stop penetration by particularly high power small arm projectiles. Plate carriers are the standard body armor utilized by those in high-risk activities and is common in military combat gear, riot control gear, and SWAT police activities.

The armored clothing of plate carriers can come in forms which are generally originally designed for military use, but are often adapted or purchased by police forces. Plate carriers include items such as interceptor body armor (IBA), the Improved Modular Tactical Vest (IMTV), and the Scalable Plate Carrier (SPC) among other designs. All of these systems are effectively an elongated vest to cover the torso and which provide for the ability to carry small arms protective insert (SAPI) plates which are plates designed to resist penetration of projectiles fired from most small arms firearms. Such small arms generally includes rifles, lower caliber machine guns, handguns, and other types of infantry portable small arms seen in modern military conflict. Most forms of plate carriers are focused on protecting the torso to protect most of a humans vital organs and their largest target surface. However, most also include optional bicep, neck, and groin protection which attach to the core vest.

The groin protection of a plate carrier will typically consist of a flexible armor flap, often in the shape of an inverted triangle, that hangs down and in front of the groin area. However, this is generally only a soft armor flap utilizing ballistic fabrics and does not carry a SAPI which is mismatched to the higher-level rifle plates the wearer is using to protect their upper torso. Specifically, the groin flap is generally unable to stop a bullet fired by a weapon stronger than a typical handgun.

SAPI are often made from materials like high density sintered ceramics, high grade AR500 steel and ultra-high molecular weight polyethylene (UHMPE). The ceramic or steel armor plates defeat the projectile being shot by simply being more dense than the projectile itself causing the round to impact on the surface. Effectively, this is a brute force method which has been a basis of armor for thousands of years. UHMPE plates are made by pressing plies of unidirectional poly material under intense heat and pressures with each layer intersecting the next in the opposite direction. This creates a material which is extremely resistant to penetration due to the amount of force required to force the fibers in the consecutive plies apart meaning this type of material defeats the projectile by making it dissipate massive amounts of force in the process of penetrating the material. In effect, UHMPE operates similarly to more standard ballistic fabrics (such as those made with para-aramid synthetic fiber and commonly known as Kevlar™), but at a much higher resistance to penetration.

UHMPE is often a preferred option in plate carriers as ceramic and steel plates are commonly very heavy being on the order of 7-10 lbs each while UHMPE plates are often around half that. However, even when using UHMPE, it should be immediately apparent that the weight of body armor can be an issue. Much like a medieval knight in full plate armor, a modern individual wearing a number of heavy plates as part of body armor will have their mobility and stamina reduced by the simple act of carrying it. As the first purpose of a plate carrier is to protect from death, and the torso is the most vulnerable, a user will commonly be forced to carry up to 20 pounds of plates before groin protection is even contemplated.

The systems herein comprise a plate and plate carrier for the groin area that has the characteristics of what one would wear on the upper torso to protect from firearms, and particularly higher power rifle fire, that can be used in conjunction with a ballistic level cup to prevent crushing injuries from movement of the plate. This will offer the same or better level of protection to the groin as is provided to the torso when a projectile of those high calibers is aimed or misdirected towards the wearer's genitals. It is also believed to provide protection against damage from explosives depending on location and direction of the explosion.

Figure 2:
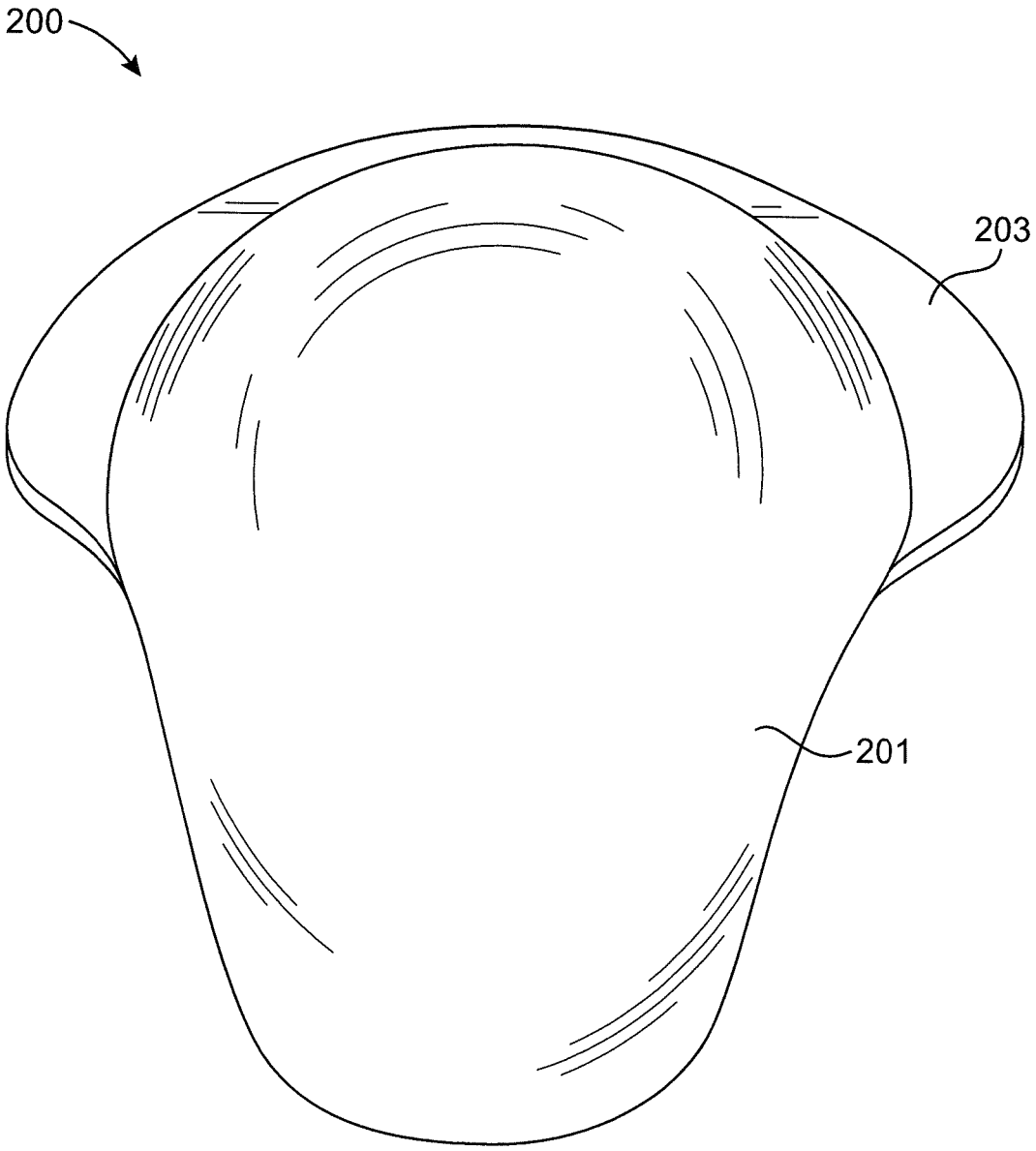
FIG. 2 shows a lower front perspective view of a first embodiment of an over armor plate for the groin.
Figure 3:
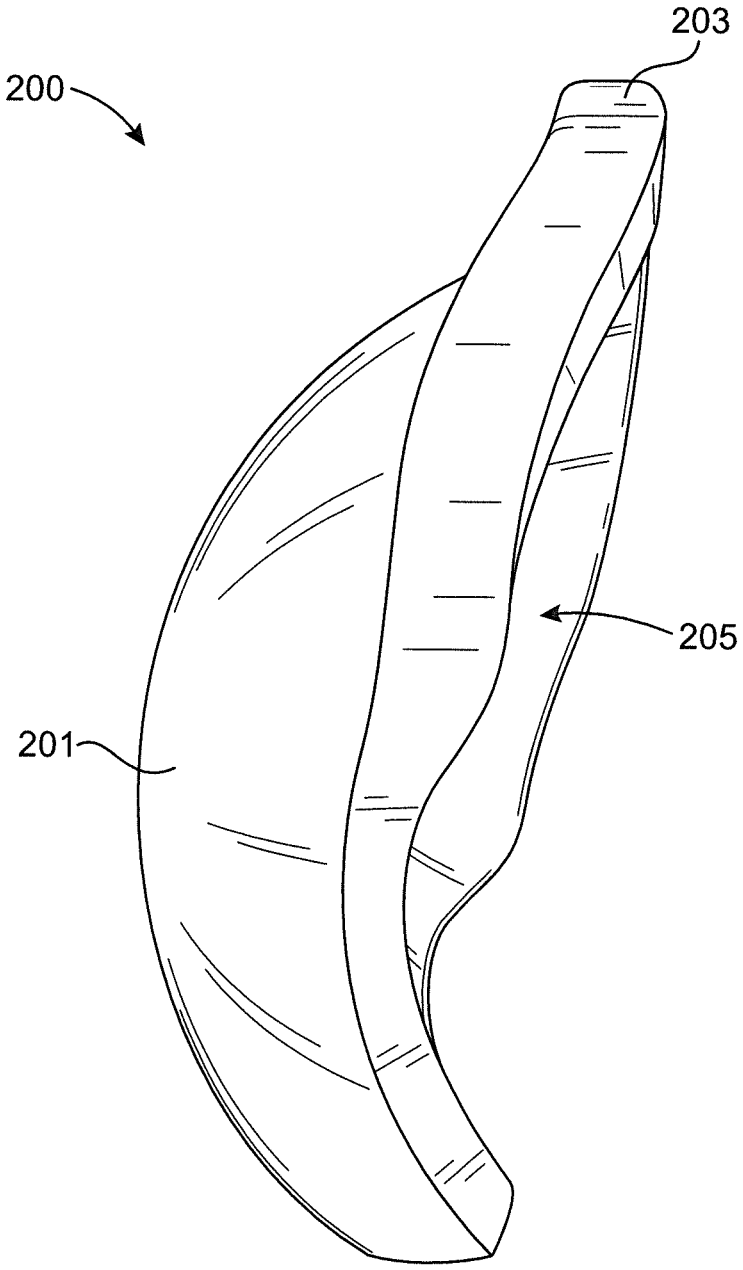
FIG. 3 shows a side view of the embodiment of FIG. 2
Figure 4:
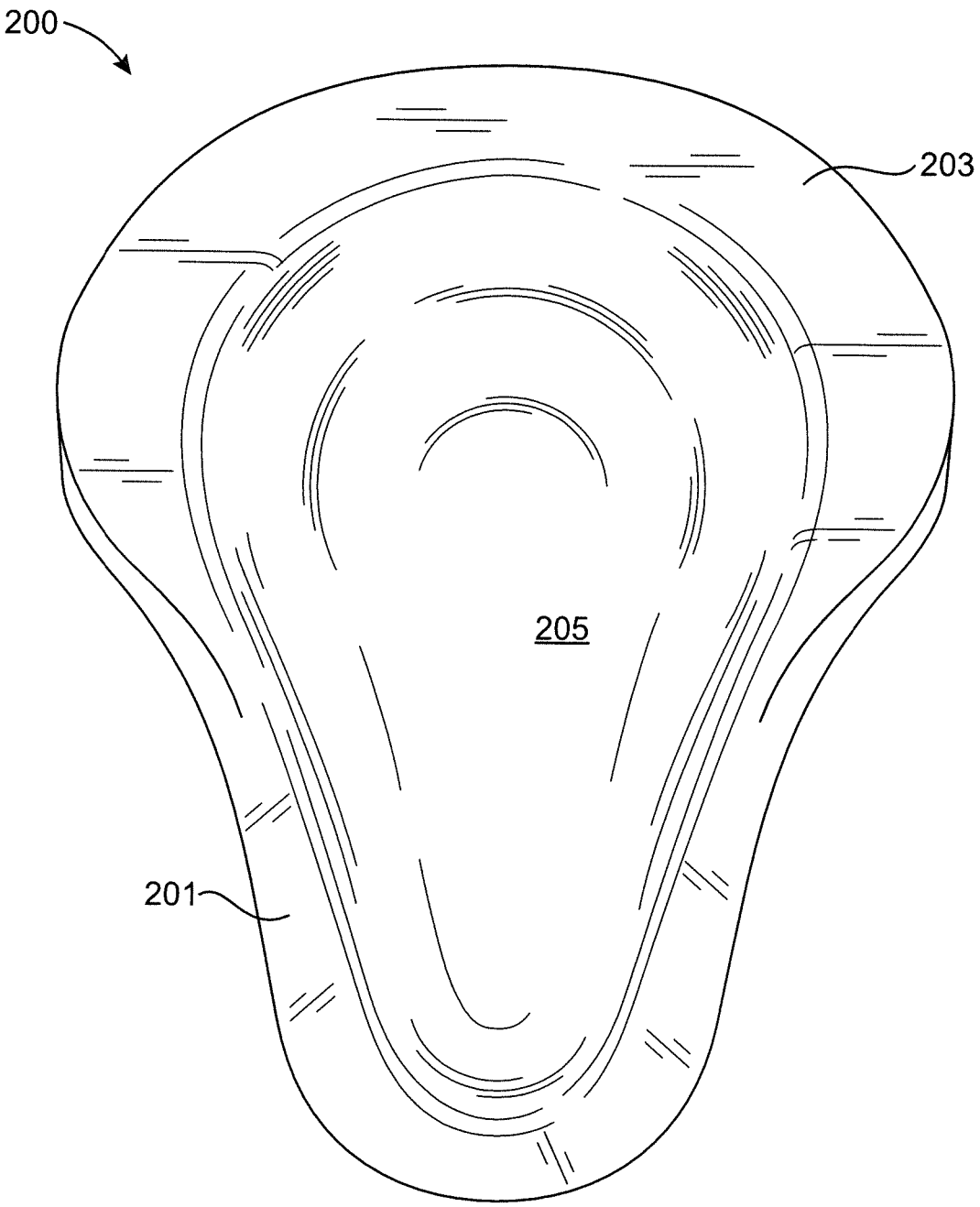
FIG. 4 shows a rear view of the embodiment of FIG. 2
Figure 5:
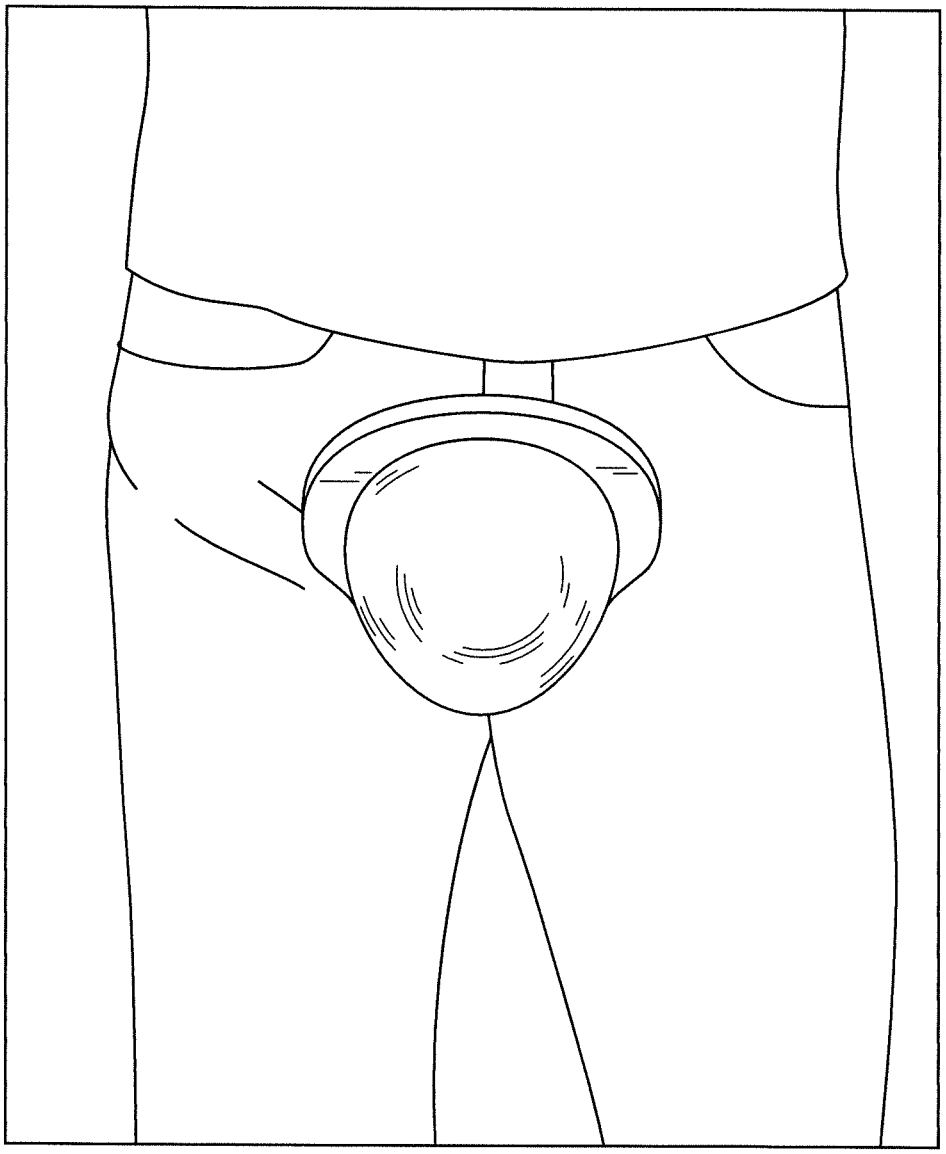
FIG. 5 shows how the armor plate of FIG. 2 is positioned over the clothing and the armored cup of FIG. 1
Figure 6:
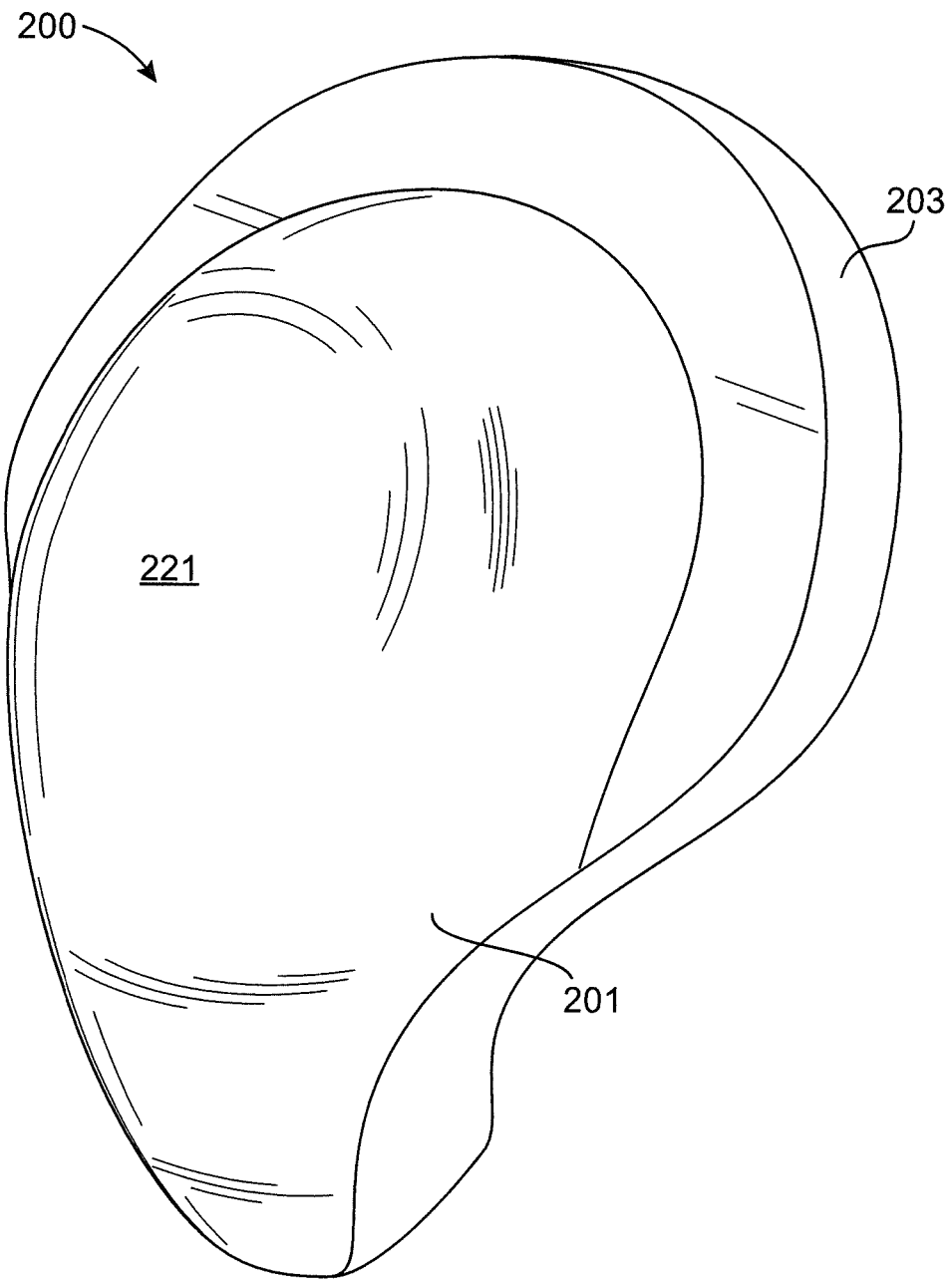
FIG. 6 shows a lower front perspective view of a second embodiment of an over armor plate for the groin.
Figure 7:
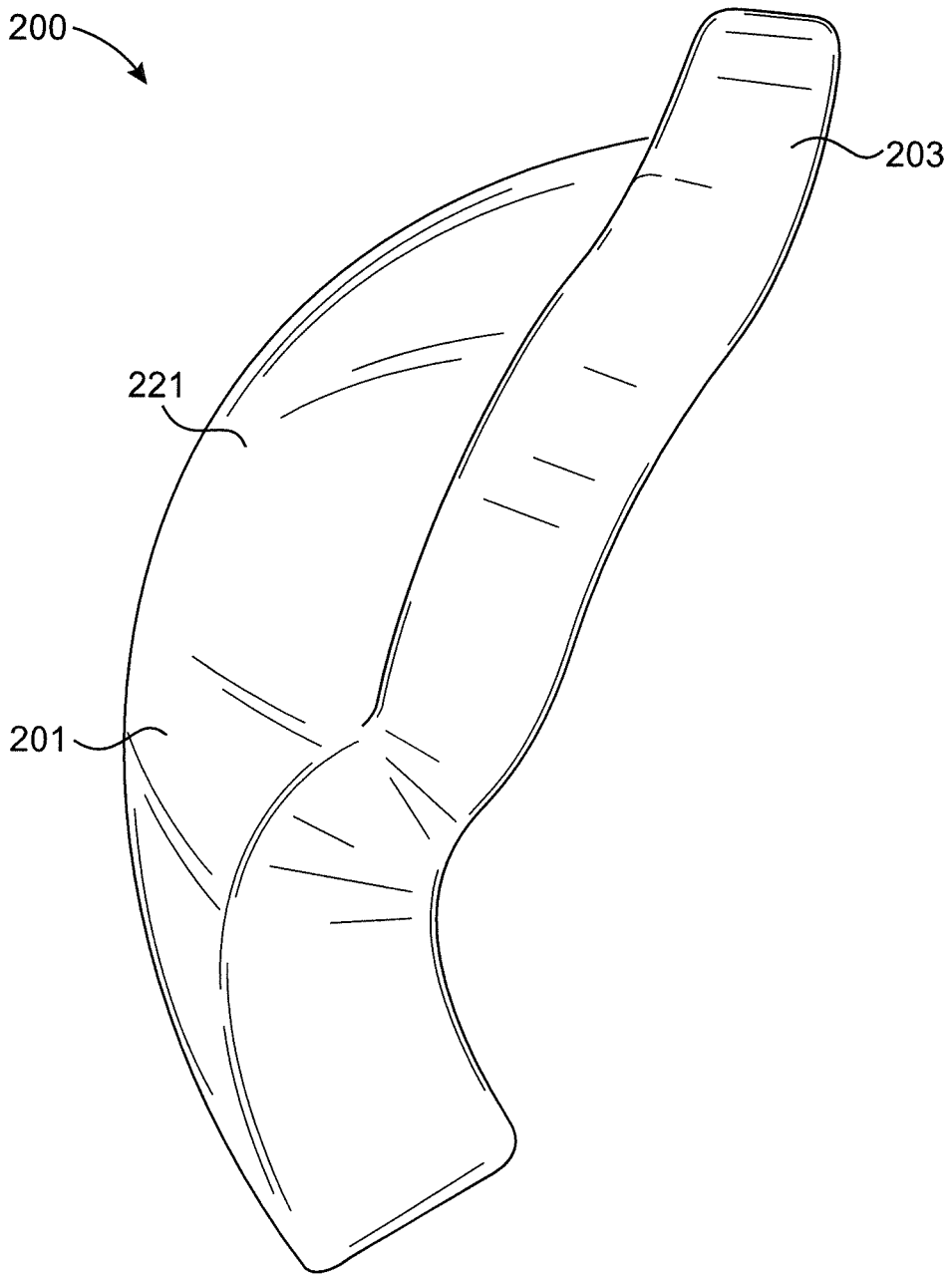
FIG. 7 shows a side view of the embodiment of FIG. 6
Figure 8:
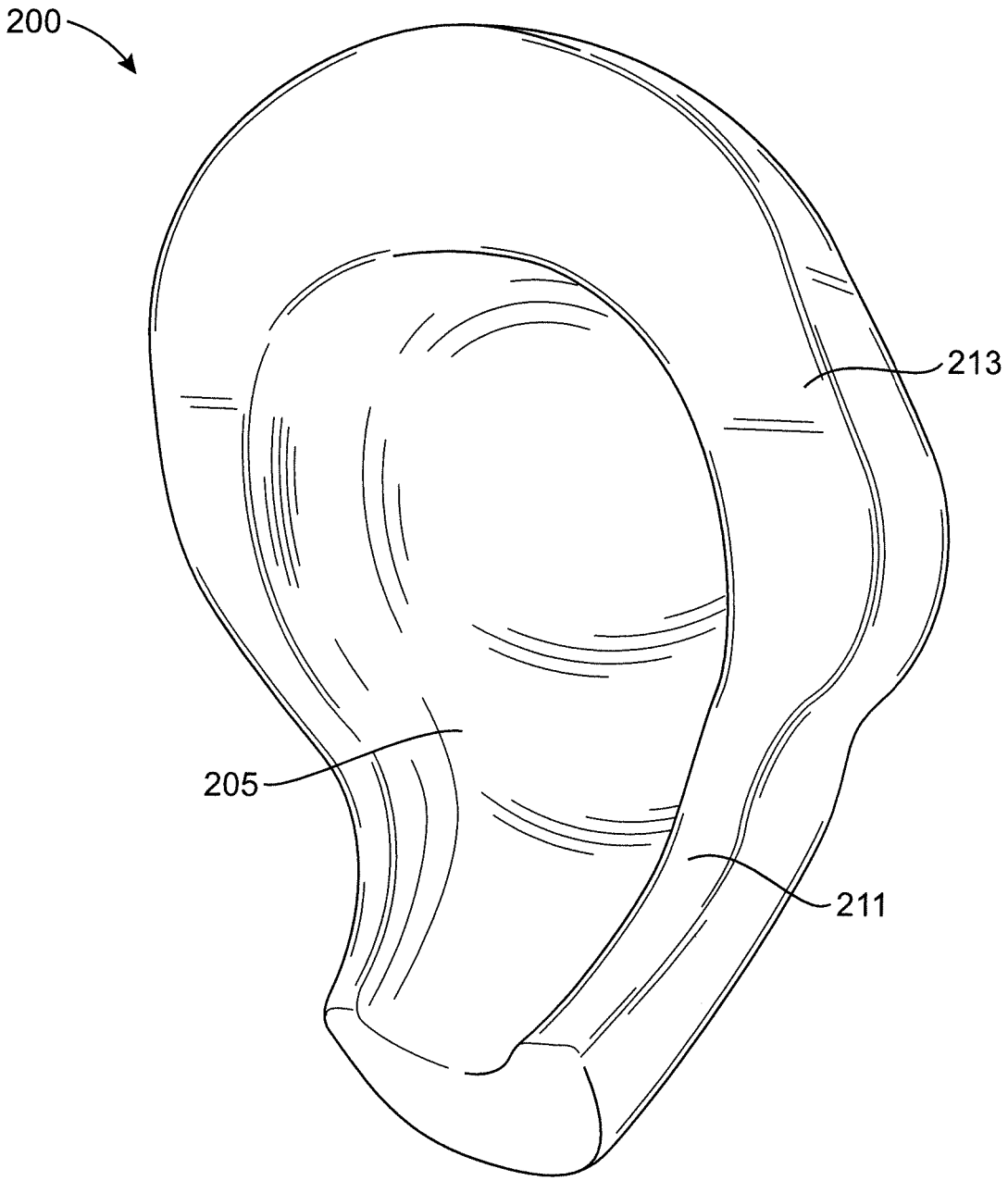
FIG. 8 shows a rear view of the embodiment of FIG. 6
Figure 9:
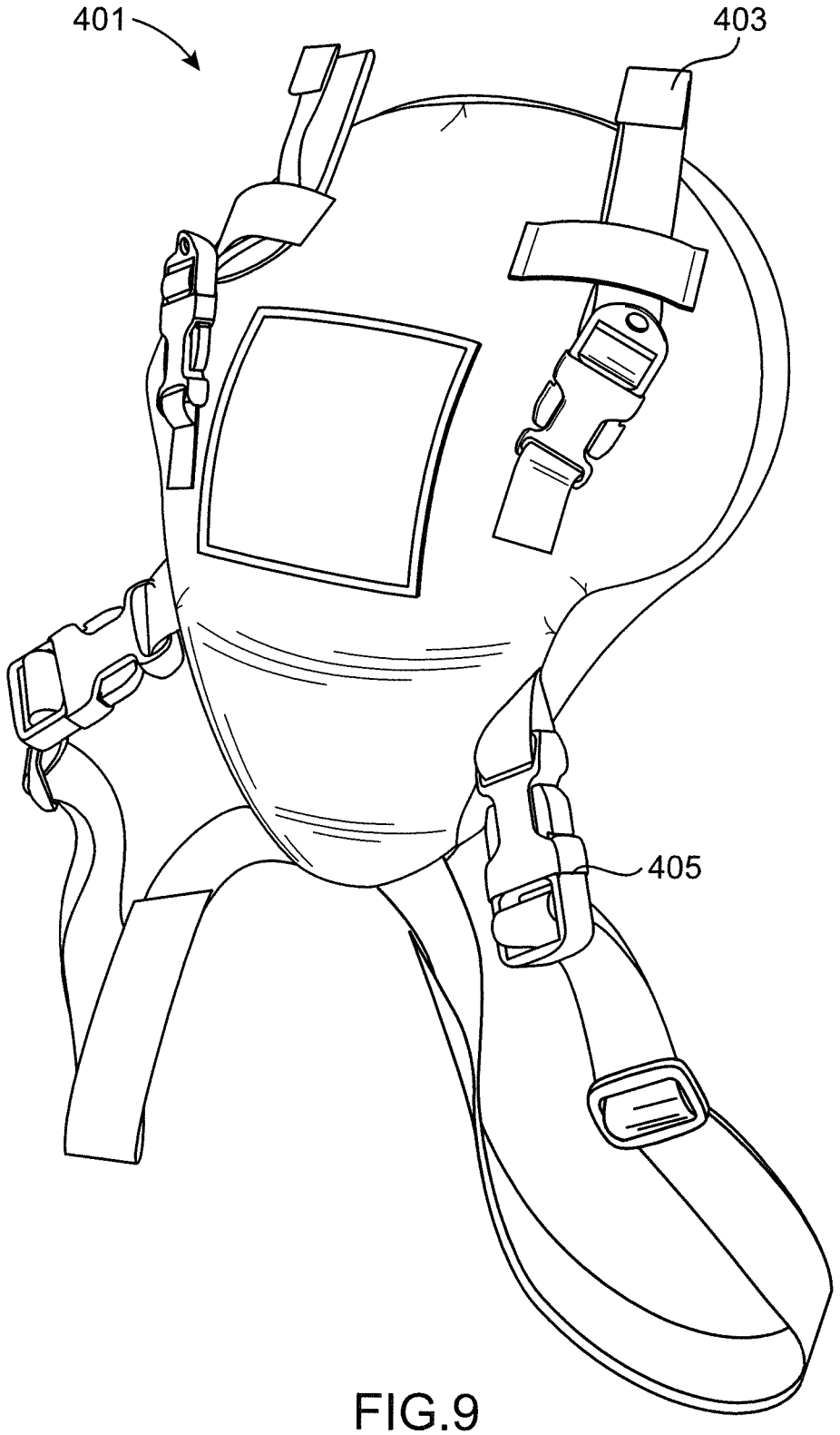
FIG. 9 shows the armor plate of FIG. 6 in a carrier device.

FIGS. 2-4 show various views of a first embodiment of an over armor plate (200) which is generally designed to be used with a ballistic cup (100). FIGS. 6-8 show a second embodiment which is of generally the same design, but includes some modifications of exact shaping and sizing. Because the two embodiments are quite similar, they will be discussed together The over armor plate (200) will be placed external to the pants with the ballistic cup (100) placed internal to the pants as loosely shown in FIG. 5 or in FIG. 10. The over armor plate (200) is of generally rounded triangular shape and has a scoop portion (201) in conjunction with a flat lip (203). The scoop portion encloses a hollow void (205). The void (205) is generally sized and shaped to accommodate placement of the ballistic cup (100) into the void (205) with the inner wall (211) of the scoop portion (201) and the inner wall (213) of the flat lip (203) generally resting against the pants which are directly in front of the ballistic cup (100). This is most clearly seen in FIG. 10.

The scoop portion (201) is also generally sized and shaped to allow it to rest against the front of the thighs of the user having a tapering end pointed down when the user is standing. This allows for the legs to move with the over armor plate (200) or to move past it when greater flexibility is required. Further, the scoop portion (201) is generally designed to hang generally straight down over the cup (100) and, in many respects, will encapsulate the front to the cup (100) while continuing to loop under the cup (100), and even slightly between the user's legs. The scoop portion (201) will generally protect the inside of the thighs and a projectile ricocheting off the scoop portion (201) will usually be directed off to the side of the user since the over armor plate (200) is front of the legs and groin. In a worst-case scenario, a bullet is expected to ricochet into solid muscle in the front of the thighs avoiding the femoral artery.

The lip (203) generally rests on the user's lower abdomen or upper hip above the cup (100) and genitalia. The lip (203) is designed to sit fairly flat against the torso or hip and serves to provide protection of the lower colon and other internal organs which may be partially exposed below a traditional vest type plate carrier. As such, the lip (203) provides protection from a shot which could hit the colon directly, but also inhibits a ricochet from a bullet which strikes the top curved surface of the scoop (201) and is directed upward. The lip (203) also provides an area in which to dissipate concussive force outside the ballistic cup (100).

Figure 10:
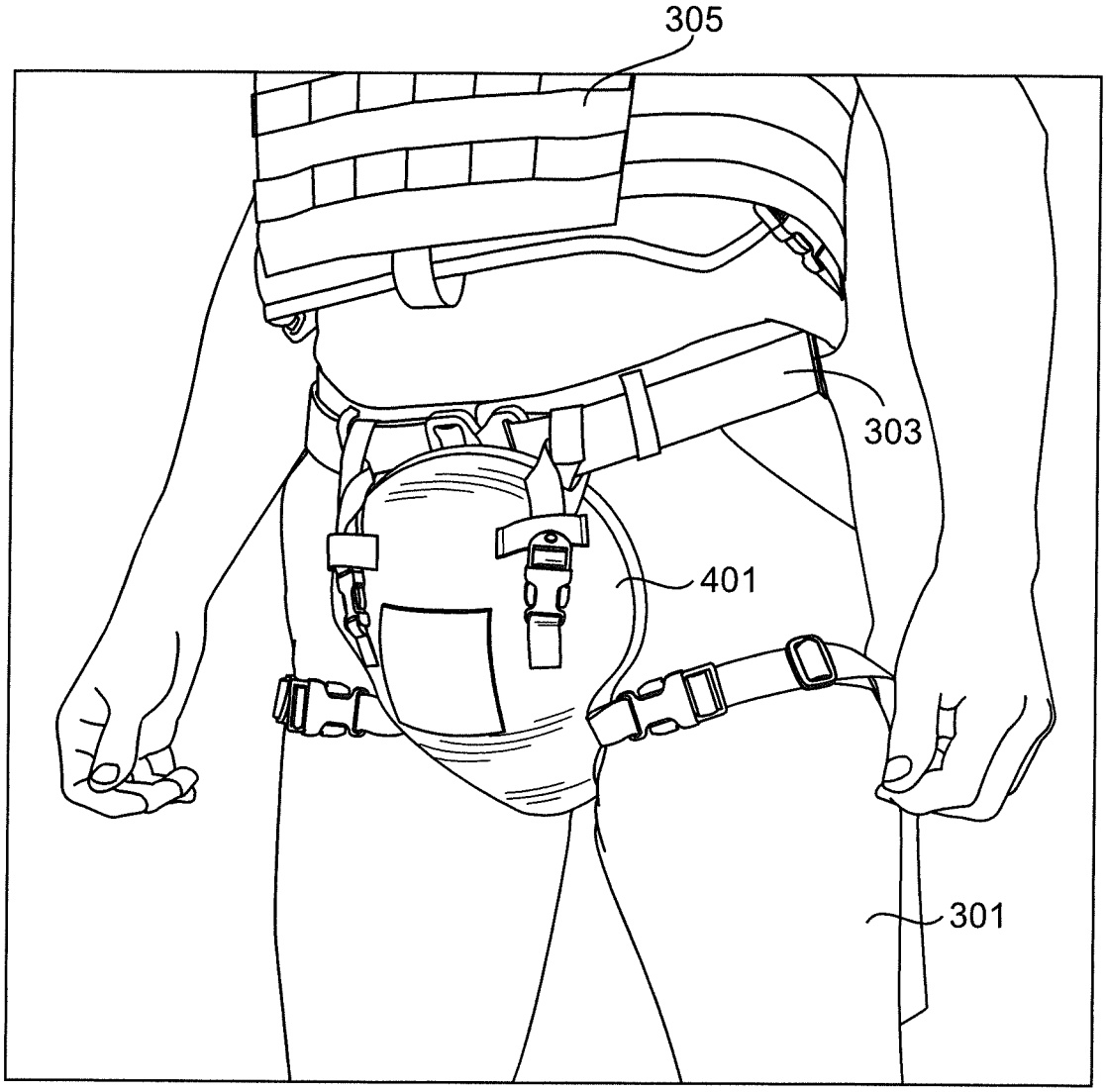
FIG. 10 shows the carrier and plate of FIG. 9 attached to a belt an in place on a user.

As best shown in FIG. 10, the over armor plate (200) will generally be worn on the outside of a user's pants (301) in a plate carrier (401) form of clothing designed to allow natural anatomical movement of the legs and hips with a ballistic cup (100) being worn inside the pants (301) at the same time. The over armor plate (200) may alternatively be worn without a covering carrier and simply attached by way of straps to the legs, waist, or a protective vest. The over armor plate (200) may be carried via a plate carrier (401) specifically designed for the legs, e.g. one which is attached via a padded belt, cummerbund, or other mechanism such as straps (403) and (405).

As shown in FIG. 10, the straps (403) may be used to attach the plate carrier (401) to a belt (303) making it separate from the traditional plate vest (305). This is generally not preferred from a protective aspect as it provides for a gap in protection as can be seen in FIG. 10 between the plate carrier (401) and traditional plate carrier vest (305). However, as twisting of the torso at the hips is often a necessary action, this arrangement can provide for more flexibility of movement.

In an alternative embodiment, the straps (403) may be used to attach the plate carrier (401) to the power portion of a plate carrier vest (305). This will typically result in the plate carrier (401) being immediately below the base of the plate carrier vest (305) and can provide for more complete protection to the abdomen. However, it may also result in increased inhibition of movement (particularly twisting) of the torso of the user at the hips as the vest (305) and plate carrier (401) are no more of a single piece structure.

The straps (405) will typically be wrapped around the legs of the user to keep the plate carrier (401) from jostling or bouncing during motion, particularly when running or otherwise moving quickly. The use of such straps is not required, but having connection to the legs will generally help to keep the plate carrier (401) in place. Further, the pressure from having the plate carrier (401) pulled back into the groin can also assist in keeping the underlying cup (100) in place as well which can result in improved comfort for the user.

The over armor plate (200) is preferably made of UHMPE due to the lighter weight but can be made from ceramics or steel depending on available materials and desired characteristics. The over armor plate (200) will generally be constructed of at least NIJ ballistic level III materials when protection from standard small arms (including rifles) is desired, but may also be constructed of NIJ ballistic level IV materials when armor piercing ammunition use is expected. Materials meeting CAST KR1, KR2, SP1, and SP2 levels for cutting and spiked implements may be selected as desired depending on both total level of protection and intended use.

One concern with regards to an over armor plate (200) constructed of UHMPE is that due to the shape of the plate (200) a projectile will not always impact the plate (200) straight on. In order to provide for ease of movement and comfort and to encapsulate the cup (100) and genitalia, the plate (200) is quite strongly curved to provide for void (205) which is different from the shape of most armor plates which are substantially flat or planar in form. Because of this, it is possible that a projectile, particularly a high powered small projectile, could impact the plate (200) at an angle which results in the projectile going into the plate (200) but then being able to travel between the various layers of UHMPE with substantially less force dissipation than traveling through the layers. Essentially, the curved shape of the scoop portion (201) allow a bullet to initially impact the front face (221) of the plate (200), but as it passes through the plate (200) have the shape of the plate slowly change to the bullet now travelling within the plate (200) almost edge on (essentially perpendicular to the face (211)). This is particularly concerning with an impact in the lower portion of the plate (200) and particularly toward the edges.

Figure 11:
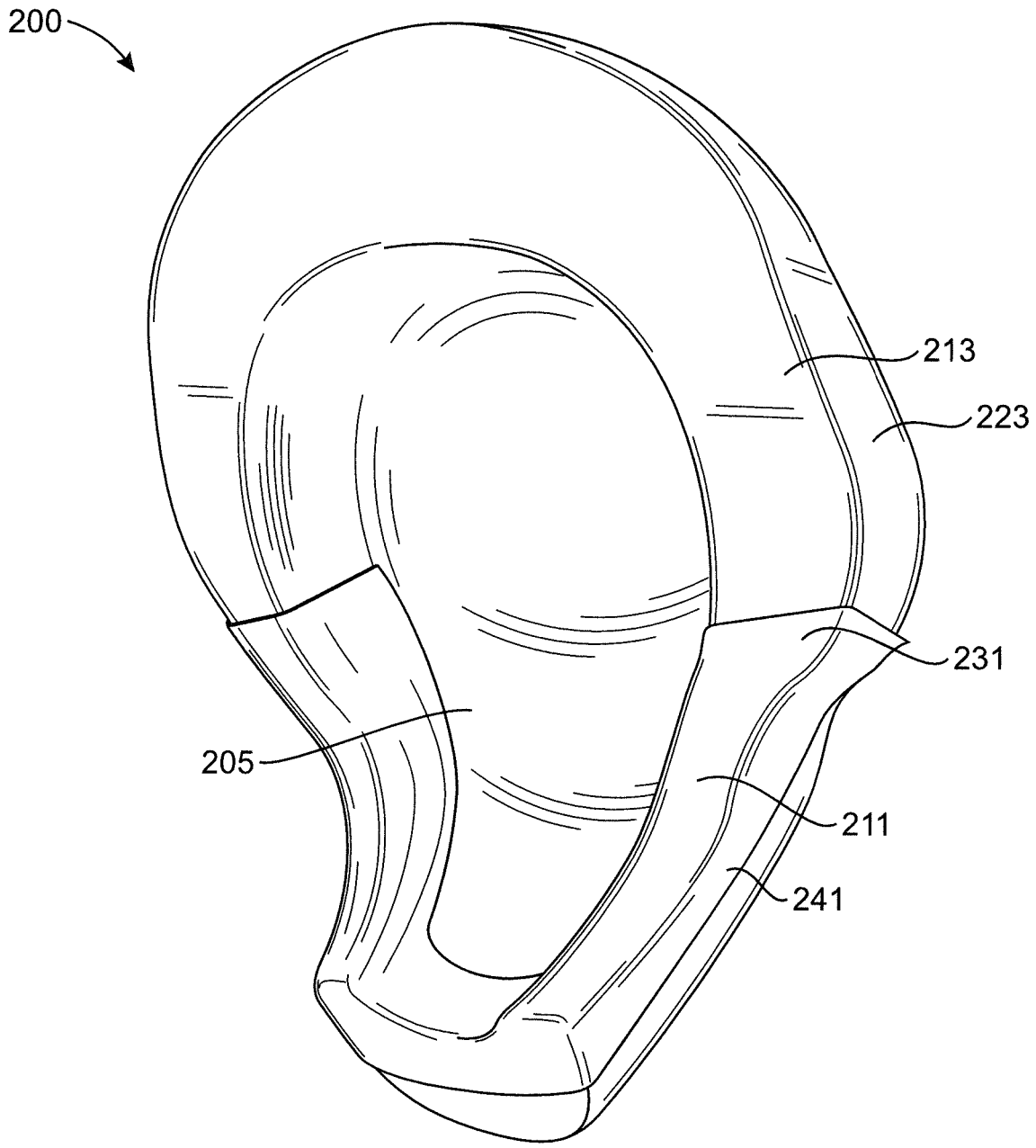
FIG. 11 shows a further embodiment of an over armor plate which includes layer separation protection.

FIG. 11 provides an embodiment of the plate (200) which is designed to deal with this particular issue. In FIG. 6 the plate (200) includes a supporting skirt (231) which surrounds and encapsulates the inner edge (211). The skirt (231) is preferably formed of a flexible ballistic material such as those made with para-aramid synthetic fiber and commonly known as Kevlar™. Alternatively, multiple layers of UHMPE may also be used it is just simply noted that their position is such that they are "end-on" the layers forming the plate (200) so that the edges of those layers are against the generally major face of the layers of the skirt (231). Generally, the skirt (231) will be wrapped around the inner edge (211) of the plate (200) as depicted, but may also be wrapped around the inner surface (213) of the lip (203). The latter, however, is generally not deemed as desirable as the lip (203) shape generally has the edges of the underlying polyethylene sheets on the edge (223) as opposed to edge (213) and therefore it is less likely a bullet could pass through the plate (200) in a way to align with a space between sheets and still exit into the body of a user.

The skirt (231) acts to form a secondary barrier to projectile penetration. The skirt (231) may extend entirely over the inner edge (211) and will extend some distance up both the inside and outside of the plate (200) as shown. Alternatively, it may completely encapsulate the plate (200), but this is generally not preferred as the interface from the skirt (231) and the plate (200) may create a new point of weakness where a projectile could slip between the layers. Instead, the skirt (231) will generally only extend a short distance up both the inside and outside sufficient to allow for a strong and rigid bond to be formed between the skirt (231) and the plate (200) but not far enough so as to present a surface of the skirt which would be readily hit by a projectile impacting the plate creating a small lip (241). The skirt (231) will generally be securely bonded to the plate (200) such as through the use of high strength adhesives or by the same techniques used to form the plate (200) itself.

Without being bound by any particular theory of operation, should a projectile impact the plate (200) at such a trajectory as to result in the projectile partially entering the structure of the plate (200), but the being diverted along a path between the various layers of the plate (200), this will generally result in the projectile passing into the plate (200) and attempting to exit at edge (211) or (223). Discharge of the projectile at edge (223) is generally not dangerous as this edge is not in contact with the user. Discharge of the projectile at edge (211) will result in the projectile contacting the skirt (231) along the inner edge (211). As the skirt (231) is folded over the inner edge (211), there is no layer separation available at this point and the projectile is forced to enter the skirt (231) at an angle generally perpendicular to the layers again. Thus, dissipation of force can be further achieved and the projectile should be rendered to minimal danger should it manage to exit through the skirt (231).

It should be recognized that the skirt (231) generally will not need to be as thick as the plate (211). Even in the scenario in which a projectile would hit the skirt (231), the projectile will have dissipated significant force passing through the plate (200), even if the passage is between layers of polyethylene and that dissipation is insufficient to stop the projectile. Therefore, the purpose of the skirt (231) is to dissipate only enough remaining energy to inhibit the projectile from leaving the skirt (231) or if it were to leave the skirt (231), from having sufficient energy to penetrate the underlying flesh in any substantial amount.

The plate (200) will also commonly have an over coating or similar material applied to smooth the outer and inner surface of plate (200) and/or skirt (231). This may be in the form of a polyurethane or polyurea coating which may be applied to either or both of the exterior and/or interior side of the plate (200) and skirt (231). The coating is not necessary, but can serve to smooth the exterior appearance and smooth over the lip (241) should one be present. It can also serve to provide for color to the plate (200) which may be desirable if the plate (200) is going to be worn without a full carrier (401) such as where having a camouflage pattern or the like on the plate (200) may be desirable.

While not intending to be limited to any theory of operation, generally, the armor system is expected to operate as follows. Should a high power ballistic attack hit the over armor plate (200), the over armor plate (200) will generally be expected to stop or otherwise deflect the projectile from penetrating the over armor plate (200) as discussed generally above in the skirt (231) scenario and is more apparent should a more direct impact occur. In effect, the plate (200) is expected to absorb the projectile in a standard fashion of a plate of known design. However, as is well known in conjunction with shots into protective plate carriers that carry high concussive force, the force of the impact will still cause the over armor plate (200) to be directed into the user with respectable and possible injurious force. This will commonly force the over armor plate (200) into the upper hip or between the legs of the user. As the over armor plate (200) is so forced, the over armor plate (200) will contact the ballistic cup (100) which is designed to resist such a blunt impact. The ballistic cup (100) will then redirect the impact force into the large muscles of the groin protecting the genitalia from impact. This will likely result in bruising and pain in the groin, but will protect the genitalia from damage.

As should be apparent from the above, the complete system of over armor plate (200) and ballistic cup (100) will offer a higher level of protection than wearing either as a stand-alone element, although either alone may be proscribed depending on threat level. A concern with simply having the over armor plate (200) is that if the plate is forced backward between the legs with sufficient force without a ballistic cup (100) being present, it is possible to catch the genitalia under the edge of the plate, which could result in severe injury, or the void (205) may be pushed into the groin too far and present a crushing injury to encapsulated genitalia.

The system is also believed to provide protection against explosions at or near the legs. Should the explosion be from an area in front of the user, the force of the explosion will generally be directed into the over armor plate (200) which will also be capable of deflecting shrapnel as much as a bullet. As the over armor plate (200) bends around and into the legs (and slightly between them), explosive force from the front, and even from underneath so long as not directly between the legs will generally be directed into the plate in the same manner as a bullet impact having the outcome discussed above. It is also believed that the dual voids provided by the over armor plate (200) and ballistic cup (100) should also assist in dissipating heat generated by an explosion resisting burning or severe overheating of the genitalia, which can also result in injury.

While the above discussion primarily has focused on ballistic level IV protection to protect a user from firearms and explosives, it should be recognized that lower level protective materials can be used for the over armor plate (200) should the over armor plate (200) be used for high risk sports activities or other activities where firearm impact is not expected. Specifically, a lower level of protection (and generally weight) will allow the over armor plate (200) to be used as a hockey goalie's secondary groin protector and also as a secondary protector for baseball umpires, catchers, and pitchers. While impact strength of the projectile is generally lower in these cases and over a wider area, the general operation of the system is believed to be the same as discussed above.

Finally, while the above description is particularly focused on the protection of male genitalia and the male groin area, it should be recognized that the armor system can also be utilized to protect the groin area and female genitalia. In this case, the protective cup will generally not need to include as substantial of a void to encapsulate the external genitalia, but the protective cup portion may extend both further up the body and may extend further between the legs to provide appropriate encapsulation. The over armor will still generally be of similar design, but may also be flatter as encapsulation of a flatter protective cup allows for a flatter over armor structure. Also, the two pieces of the system may again be utilized together or individually.

It should also be recognized that while certain design considerations can be desirable for female anatomy to provide for better freedom of movement and improve protection based on the relative position of female genitalia relative to the legs compared to male genitalia, there is no reason that the armor systems discussed herein cannot be utilized on a female body as is.

The qualifier "generally," as used in the present case, would be understood by one of ordinary skill in the art to accommodate recognizable attempts to conform a device to the qualified term, which may nevertheless fall short of doing so. This is because terms such as "sphere" are purely geometric constructs and no real-world component is a true "sphere" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and geometric relationships contemplated herein regardless of the inclusion of such qualifiers to include a range of variations from the literal geometric meaning of the term in view of these and other considerations.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The invention claimed is:

1. An armor system for use in protecting the groin, the armor system comprising:

a ballistic cup comprising a first void; and an armor plate including:

a scoop portion forming a second void; and a lip portion extending from a top of the scoop portion;

wherein said ballistic cup is placed inside pants of a human user with said first void in said ballistic cup encapsulating genitalia; and wherein said armor plate is positioned external to said pants placing said ballistic cup into said second void in said scoop portion.

2. The system of claim 1, wherein said armor plate is positioned with a carrier.

3. The system of claim 2, wherein said carrier includes straps connecting said carrier to legs of said human user.

4. The system of claim 2, wherein said carrier includes straps connecting said carrier to a belt around a waist of said human user.

5. The system of claim 2, wherein said carrier includes straps connecting said carrier to a vest worn by said human user.

6. The system of claim 5 wherein said vest is a plate carrier vest.

7. The system of claim 1 wherein said plate is formed of high density sintered ceramic.

8. The system of claim 1 wherein said plate is formed of high grade AR500 steel.

9. The system of claim 1 wherein said plate is formed of ultra-high molecular weight polyethylene (UHMPE).

10. The system of claim 1 further comprising a skirt which is wrapped around an edge of said plate.

11. The system of claim 10 wherein said skirt is formed of ultra-high molecular weight polyethylene (UHMPE).

12. The system of claim 10 wherein said skirt is formed of flexible ballistic material.

13. The system of claim 10 wherein said skirt is formed of para-aramid synthetic fiber.

14. The system of claim 10 wherein said plate and said skirt are coated with a coating.

15. The system of claim 14 wherein said coating is a polyurethane coating.

16. The system of claim 14 wherein said coating is a polyurea coating.

17. The system of claim 1 wherein said human user is male.

18. A method for protecting the groin, the method comprising:

providing a ballistic cup comprising a first void:

providing an armor plate including:

a scoop portion forming a second void; and a lip portion extending from a top of the scoop portion;

placing said ballistic cup inside pants of a human user with said first void in said ballistic cup encapsulating genitalia; and positioning said armor plate external to said pants with said ballistic cup positioned in said second void in said scoop portion.

* * * * *